US007762742B1

(12) United States Patent
Smith

(10) Patent No.: US 7,762,742 B1
(45) Date of Patent: Jul. 27, 2010

(54) RESIDENTIAL FLOOD CONTROL UNIT

(76) Inventor: Clarence E. Smith, 5116 Cold River Ave., Las Vegas, NV (US) 89130

( * ) Notice: Subject to any disclaimer, the term of this patent is extended or adjusted under 35 U.S.C. 154(b) by 437 days.

(21) Appl. No.: 11/713,911

(22) Filed: Mar. 5, 2007

Related U.S. Application Data

(60) Provisional application No. 60/778,602, filed on Mar. 3, 2006.

(51) Int. Cl.
*E02B 7/02* (2006.01)
*E02B 7/20* (2006.01)

(52) U.S. Cl. ..... 405/114; 405/115; 405/91

(58) Field of Classification Search ..... 405/91, 405/107, 114, 115, 62
See application file for complete search history.

(56) References Cited

U.S. PATENT DOCUMENTS 3,162,920 A * 12/1964 Durham ..... 24/265 R
4,650,368 A 3/1987 Bayer
5,439,316 A 8/1995 Richardson
5,443,880 A * 8/1995 Wike ..... 428/78
5,460,462 A 10/1995 Regan
D407,013 S 3/1999 Armondo
5,988,946 A 11/1999 Reed
6,079,904 A * 6/2000 Trisl ..... 405/107
6,126,362 A * 10/2000 Carter et al. ..... 405/114
6,328,050 B1 * 12/2001 McConnell ..... 135/137
6,338,594 B1 1/2002 Adler et al.
6,514,011 B2 2/2003 Nomura et al.
6,783,300 B2 * 8/2004 Doolaege ..... 405/115
6,957,928 B1 * 10/2005 Lofton ..... 405/115
2002/0110424 A1 * 8/2002 Page ..... 405/115
2005/0260038 A1 * 11/2005 Sousa Costa ..... 405/115

* cited by examiner

*Primary Examiner*—Frederick L Lagman
(74) *Attorney, Agent, or Firm*—Montgomery Patent and Design; Robert C. Montgomery; Joseph T. Yaksich

(57) ABSTRACT

The present invention comprises an apparatus that is designed to hold back flood waters via a series of interconnected long flexible tubular units. Each unit is connected to each other via a sleeve and has a weighted flap portion for additional anchoring. Each unit has its own fill tube and drain plug and is designed to retain water or other liquid to provide an impervious water barrier when in deployment.

8 Claims, 2 Drawing Sheets

RESIDENTIAL FLOOD CONTROL UNIT

RELATED APPLICATIONS

This application claims the benefit of U.S. Provisional Application No. 60/778,602 filed on Mar. 3, 2006, the entire disclosures of which are incorporated herein by reference.

FIELD OF THE INVENTION

The present invention relates generally to a system and method to restrain minor flooding near residential structures via a series of interconnected, flexible tubular units and, more particularly, to each tubular unit connected one to the other by means of a weighted flap portion for additional anchoring.

BACKGROUND OF THE INVENTION

When disaster strikes, every second counts in preventing the loss of life or property. This is especially the case when dealing with floods where water can rise at alarming rates, engulfing entire towns and destroying family belongings that have been collected over many generations. As a result, family heirlooms such as photographs, antiques and other irreplaceable items risk being lost forever, without hope for recovery. This being the case, people are willing to go to great lengths to ensure the safety of their homes and belongings during floods caused by hurricanes, tornados and floods. Unfortunately, with the exception of sandbags, dikes, and massive construction projects, there is little that can be done to protect ones home or building against the ravages of a flood. Accordingly, there is a need for a means by which flood waters from natural disasters can be controlled in a manner that is quick, easy, and effective while doing it in a cost-effective manner. The development of this unique system and method fulfills this need.

Providing a temporary solution to the need identified immediately above, is the method and system incorporating an apparatus that is designed to hold back flood waters in much the same manner as a sand bag. The invention takes the form of a series of long flexible plastic tubes, each approximately 18 inches in diameter and approximately 25 to 50 feet long. Each tube contains a fill port which allows the user to fill the tube with water or similar fluid. Additional tubes can be stacked next to or on top of the first tube to form a complete barrier to flood waters. When filled, each tube conforms to the local ground conditions and to other tubes to form a complete barrier that is virtually impervious to water. When the need for such flood water protection has passed, the tubes can be emptied and stored for reuse at a later time. The invention is intended for use in areas subject to frequent flooding by rivers or streams and in coastal areas that may suffer from frequent encounters with hurricanes, tidal waves and the like. The use of the residential flood control system safely controls flood waters resulting from natural disasters in a manner that is quick, easy and effective thus protecting personal property and belongings.

Several attempts have been made in the past to develop a system and method to restrain minor flooding near residential structures via a series of interconnected, flexible tubular units and, more particularly, to each tubular unit connected one to the other by means of a weighted flap portion for additional anchoring. U.S. Pat. No. 6,338,594 in the name of Adler, et al discloses a movable barrier wall system that includes a housing assembly that has an interior chamber. A barrier member is made of a buoyant material having a selected density. The barrier member floats vertically within the chamber when a liquid is present. The barrier member may be made from a closed cell foam core that is clad with a fiberglass mesh material, and then the assembly is infused with a resin material. Alternatively, the core may be made from a plurality of elongated rods that are individually clad and reinforced with a shear layer. The individual barrier member modules may be assembled in an end to end relationship with an elongated vertical seal member therebetween. The barrier member may be selectively raised prior to and in anticipation of a flood situation of a nearby body of water by a pump and control system that may be automatically or manually controlled. At least one passive backup system is provided for filling the chamber when the pump or control system fails. The system includes a second pump for selective removal of the liquid from the chamber. Unfortunately, such a prior art system is cumbersome to move and store, is difficult to erect, and requires use of a pump system.

U.S. Pat. No. 6,514,011 in the name of Nomura, et al discloses a movable water-protection apparatus capable of driving a water barrier plate manually or automatically when needed. The movable water-protection apparatus includes a water barrier plate for shutting out water, such as seawater, river water, and rainwater, likely to intrude into a basement and a driving device for driving the water barrier plate upward from an underground position along a guide device or a side plate. The water barrier plate is disposed in an underground space at an entrance of the basement. The driving device has a water pressure type piston/cylinder unit to which service water is supplied. Unfortunately, this prior art example requires professional installation below a ground surface of a property, is expensive to install, and mars the ground surface of the property.

U.S. Pat. No. 5,460,462 in the name of Regan describes a liquid barrier system that includes a structure forming a below ground level float-receiving chamber. An inlet passageway for round water or other liquid directs the liquid into the bottom of said chamber to fill the chamber when it is desired that a barrier wall-forming part of the barrier system is to rise above ground level. Where the barrier system is a flood water barrier, the chamber bottom connects with a sewer system so that the chamber does not fill unless flood risk conditions exist, as when sewer back-up occurs. A float structure with which the barrier wall is associated is vertically movable in the chamber from a bottommost position therein when there is no liquid build up therein to an uppermost position when said liquid rises therein where the barrier wall is substantially above ground level. Seals are provided which prevent the liquid from gaining access to said one side of the barrier wall. The seal preferably include surfaces on the housing structure and surfaces on the float structure which surfaces engage and are pressed into sealing relation by the buoyancy forces on the float structure when it reaches its uppermost position. Unfortunately, this prior art example requires connection with an existing sewer, which may not be possible for all properties needing flood protection.

None of the prior art particularly describes a system and method to restrain minor flooding near residential structures via a series of interconnected, flexible tubular units and, more particularly, to each tubular unit connected one to the other by means of a weighted flap portion for additional anchoring.

Accordingly, there is a need for a system which provides such features while overcoming the above-mentioned shortcomings.

SUMMARY OF THE INVENTION

In view of the foregoing disadvantages inherent in the prior art, it has been observed that there is need for a system and method to restrain minor flooding near residential structures via a series of interconnected, flexible tubular units and, more particularly, to each tubular unit connected one to the other by means of a weighted flap portion for additional anchoring.

An apparatus for holding back low-level flood waters pooled adjacent to a building structure foundation includes a plurality of detachably interconnected bladder units positioned end-to-end along an edge of the flood waters, and adaptable for housing a predetermined volume of fluid therein. Each of such bladder units includes a sleeve advantageously interconnected with an adjacent one of the bladder units which is essential to thereby conveniently form a continuous barrier to effectively prevent undesirable encroaching of the flood waters. By forming a continuous barrier, flood waters are advantageously prevented from seeping through openings in the barrier, or undermining the integrity of the apparatus and thereby inhibiting the apparatus's ability to prevent flood water from undesirably penetrating a building structure.

Such a sleeve has a proximal end circumferentially permanently and integrally connected to a first end of an associated one of the bladder units, and extends distally and longitudinally away from the first end wherein a distal end of the sleeve is directly mated to an adjacent one of the bladder units, without the use of intervening elements, which is critical for creating a continuous series of interconnected bladder units. The bladder units are flexible, which is crucial for allowing a user to advantageously manipulate and position the bladder units about obstacles located on the ground surface.

The apparatus further includes a plurality of flaps pivotally attached to each of the bladder units respectively, and each bladder is advantageously provided with a fill plug and a drain plug operably attached thereto. The flaps further include at least one pouch formed along a body thereof, and at least one weight member removably positioned within the pouch for effectively preventing the bladder unit from undesirably traveling along the ground surface. For example, when a quantity of water contacts the apparatus, the force of the water will displace the apparatus from its desired position if not for the weights. The flaps are attached to an upper central region of the bladder units and extend along an entire longitudinal length thereof respectively. The flaps further extend downwardly and outwardly along a ground level towards the flood waters. The flaps are connected longitudinally to an upper central region of the bladder unit and extend downwardly and outwardly to approximately double a diameter of the bladder.

The fill plug is located on an upper half surface of the bladder unit, and includes a tubular orifice provided with a threaded cap attached thereto. Such a fill plug allows a user to easily introduce fluid into the bladder via the use of an existing garden hose attached to a building water spigot, as an example. The drain plug is located on a lower half of the bladder unit for draining the fluid out from the bladder unit. Such a drain plug allows a user to easily drain fluid from the bladder by removing the drain plug and exerting a downward force on the bladder until the desired quantity of fluid is removed therefrom.

The apparatus further includes a mechanism for advantageously anchoring the flaps to the ground during operating conditions, which is vital such that the bladder units are effectively prohibited from being displaced along the ground surface. The anchoring mechanism includes a plurality of anchoring straps and a plurality of anchoring rods. Such anchoring straps are permanently coupled directly to the flap, without the use of intervening elements, and terminate away from a lateral edge thereof. Each of the anchoring straps is advantageously provided with an eyelet wherein the anchoring rods are driven through the eyelets and into the ground, which is necessary to thereby securely fasten the bladder unit to the ground. The anchoring mechanism cooperates with the weighted pouches to provide sufficient stability for the bladder units to prevent same from being displaced along a ground surface when flood waters contact the bladder units and encroach upon the building structure being protected.

The flexibility of the bladder units provides the unexpected benefit of allowing a user to manipulate and position the bladder units about obstacles located on a ground surface, and allows a user to adapt the apparatus to different types of ground surfaces regardless of the topography. In addition, a user is able to easily employ the apparatus in different locations based on need, and store the apparatus in a building structure, thereby obviating the need to have the apparatus installed below a ground surface. The above mentioned benefits overcome the shortcomings of the prior art.

A method for deploying a flood barrier apparatus to prevent flood waters from penetrating into a building structure includes the steps of determining a requisite position and a requisite quantity of bladder units based upon surface topography and a shape of the building structure. Each of the bladder units includes a sleeve extending outwardly from an end thereof. The method further includes the steps of attaching the plurality of bladder units by inserting adjacent ends of the bladder units completely into corresponding ones of the connecting sleeves, anchoring the bladder units into position along a ground surface, filling the bladder units with fluid to capacity by exhausting all entrapped air from the bladder units to eliminate unwanted floating of the bladder units, disconnecting each of the bladder units from the corresponding sleeves, and removing the fluid from each of the bladder units by removing an associated drain plug from each of the bladder units.

The step of determining a requisite position and a requisite quantity of bladder units based upon surface topography and a shape of the building structure further includes the step of placing the bladder units in the pathway of rising flood waters by orienting the bladder units in such a way as to channel the flood waters towards a safer and less destructive path.

The step of anchoring the bladder units into position along a ground surface includes the step of inserting a weight member into a pouch formed within a flap portion of the bladder units wherein the weight member is placed on a water side of the bladder units, and driving a plurality of anchoring rods through eyelets formed within the plurality of anchoring straps by inserting the anchoring rods into the ground surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | residential flood control system |
| 11 | flap |
| 12 | bladder unit |
| 13 | fill plug |
| 14 | connecting sleeve |
| 15 | drain plug |
| 16 | anchor strap |
| 17 | weight |
| 18 | anchoring rod |
| 19 | eyelet |
| 50 | low-level floodwater |

DETAILED DESCRIPTION OF THE PREFERRED EMBODIMENT

Figure 1:
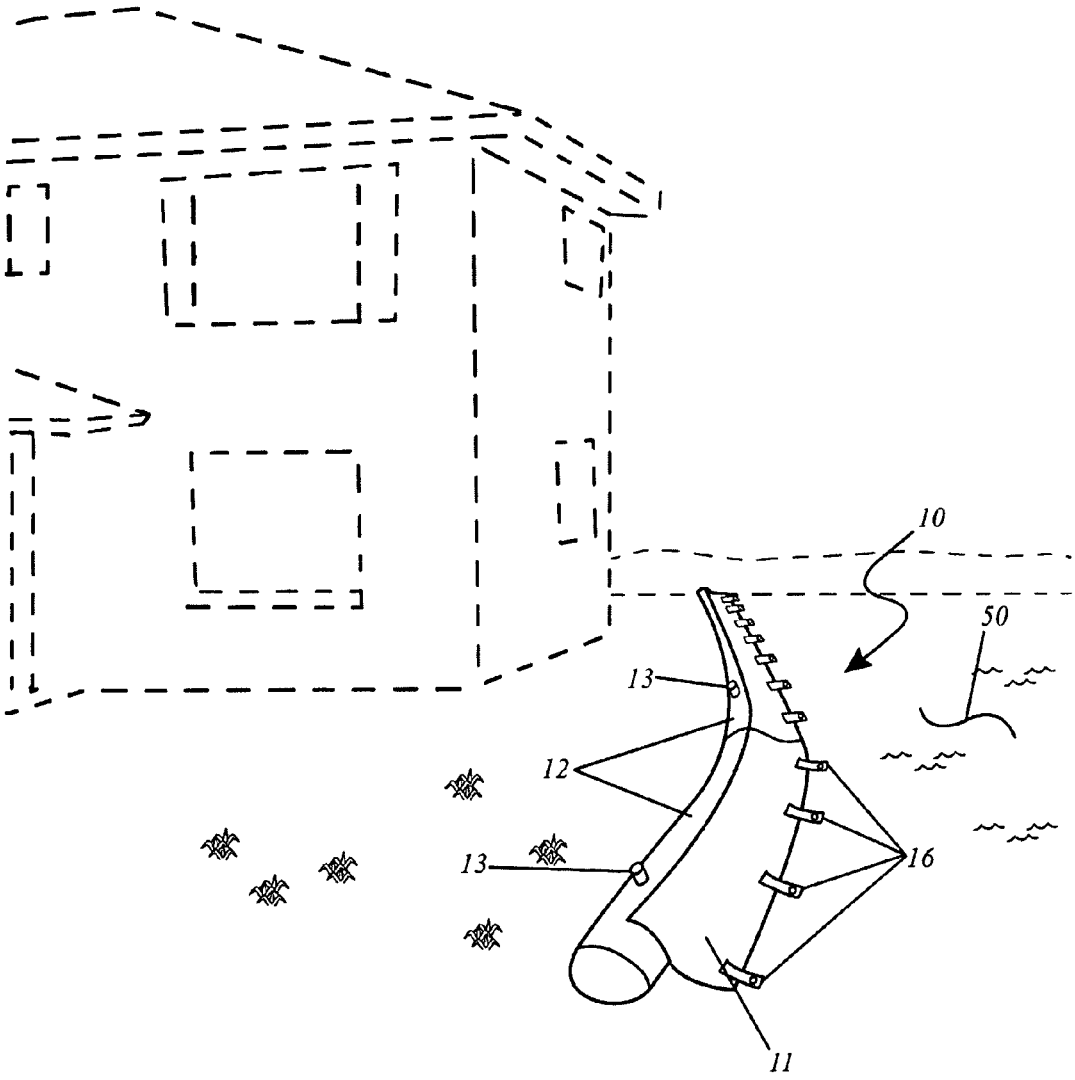
FIG. 1 is a perspective view of a single unit for the residential flood control system 10, according to a preferred embodiment of the present invention; and, FIG. 2 is a perspective view of the residential flood control system 10, according to a preferred embodiment of the present invention.
Figure 2:
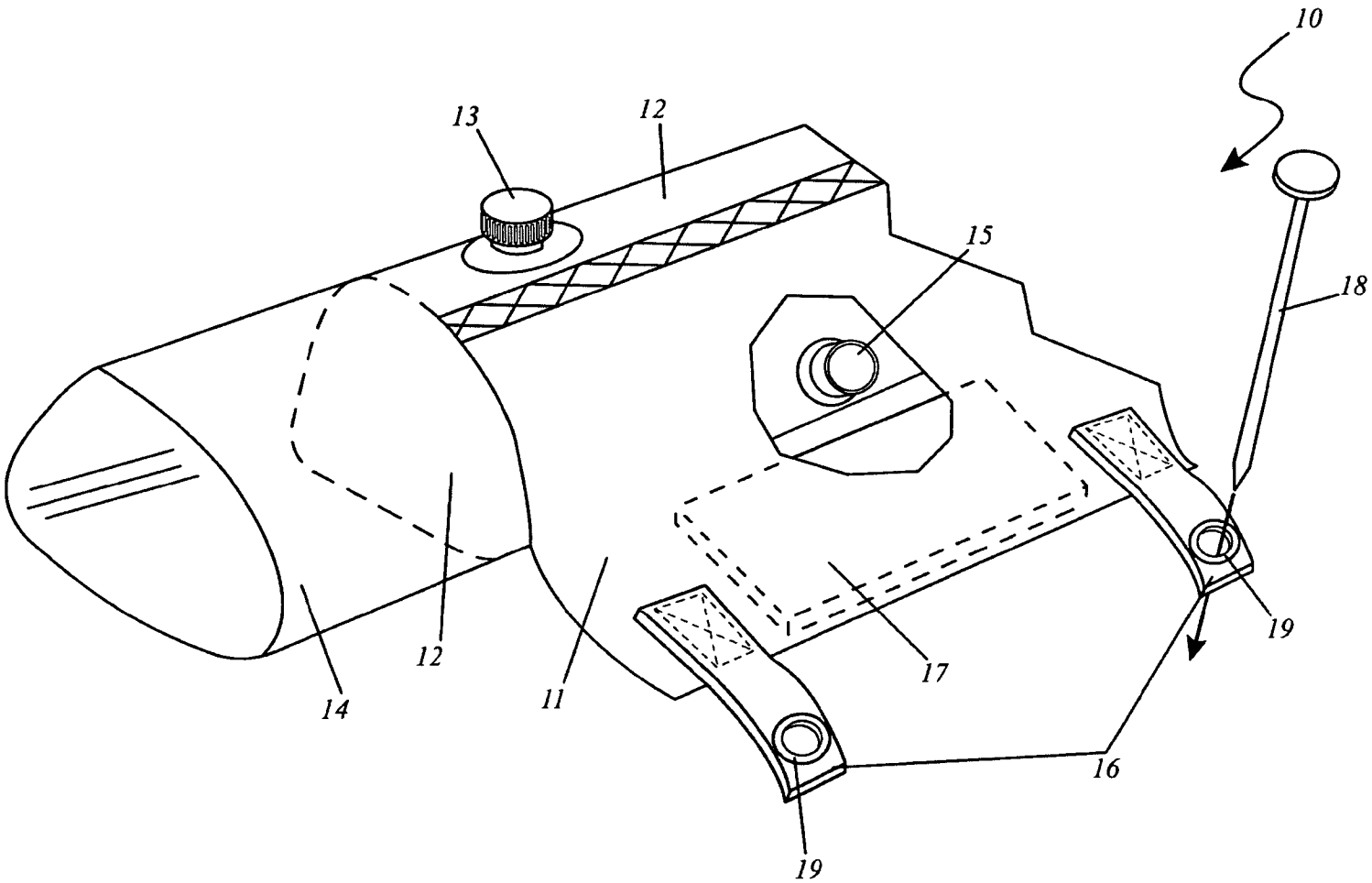

The best mode for carrying out the invention is presented in terms of its preferred embodiment, herein depicted within FIGS. 1 through 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for a residential flood control system (herein described as the "apparatus") 10, which provides a means for holding back low-level flood waters 50 via a series of interconnected long flexible bladder units 12. Each bladder unit 12 is connected to an adjacent unit via an interconnecting sleeve 14 forming a continuous barrier to encroaching low-level floodwaters 50. Each bladder unit 12 comprises a weighted flap portion 11 for additional anchoring, its own fill plug 13, and a drain plug 15.

Referring now to FIG. 1, an environmental view of the apparatus 10, according to the preferred embodiment of the present invention, is disclosed. The apparatus 10 is illustrated here at the edge of a residential driveway; however, the present invention 10 may be applied thereto in a variety of locations such as around building foundations, the edge of gardens, and the like, and as such should not be interpreted as a limiting factor of the present invention 10. The apparatus 10 is illustrated here as a series of individual bladder units 12 interconnected with one another to form an extended barrier to control floodwater 50.

The plurality of single bladder units 12 made of heavy-duty plastic or rubber construction and designed to receive water or other liquid to fill to capacity. The individual bladder 12 is approximately eighteen (18) inches in diameter and twenty-five (25) to fifty (50) feet long. A flap 11 is connected longitudinally to the upper center of the bladder 12 and extends downward and outward to approximately double the diameter of said bladder 12. The flap 11 is weighted with an internal high density plate within a plastic or rubber cover or is inherently of a heavier construction than the bladder 12 and is designed to anchor the entire bladder unit 12 when filled with a liquid and in deployment during flood conditions.

Referring now to FIG. 2, a perspective view of the apparatus 10, according to the preferred embodiment of the present invention, is disclosed. The apparatus 10 comprises a bladder unit 12, a fill plug 13, a drain plug 15, a flap 11, and a plurality of anchor straps 16 comprising a plurality of eyelets 19, a weight 17, and an anchoring rod 18. The bladder unit 12 comprises a cylindrical vessel of approximately eighteen (18) inches in diameter and twenty-five (25) to fifty (50) feet long. The bladder unit 12 is envisioned to be made using materials such as, but not limited to, heavy gauge polyvinylchloride (PVC) plastic sheet, rubber sheet, or the like thereby providing sufficient strength to contain the pressure of the water filled to capacity therein.

A sleeve 14 of similar construction to that of the bladder 12 permanently and integrally connected to said bladder 12 circumferentially and extending longitudinally away on one (1) side of the bladder 12 to a length of approximately one (1) foot is designed to receive a second bladder unit 12 therein. The connection of the second and subsequent bladder units 12 via the sleeve 14 portion provides for a series of interconnected bladder units 12 with an impervious water barrier when filled with a liquid.

The connecting sleeve 14 is envisioned to be made using similar materials and construction to that of the bladder unit 12. The connecting sleeve 14 provides an attachment means to one (1) end of said bladder unit 12 in a circumferential manner extending longitudinally to a length of approximately one (1) foot. The connecting sleeve 14 provides a slidingly attachable means for a plurality of connected bladder units 12. The said bladder units 12 when filled with water and secured to the ground provide an impervious water barrier.

A fill plug 13 is located on the protected side of the bladder unit 12 and most typically on the upper half of the bladder unit 12. The fill plug 13 comprises a tubular pop-out type orifice with a threaded cap being similar to those used for air mattresses and the like. The fill plug 13 may be deployed to access the threaded cap for filling with water or may be extended into the bladder unit 12 when not in use. The fill plug 13 orifice is designed to adapt to conventional garden water hoses or similar devices. A drain plug 15 is also located on the bladder unit 12, most typically on the lower half and functions to effectively drain the bladder unit 12 of liquid when use of the apparatus 10 is no longer needed. The drain plug 15 is envisioned to be similar in construction to the fill plug 13.

A flap 11 is attached longitudinally to the upper center of the bladder unit 12 using durable construction methods such as RF welding, adhesives, or the like. The flap 11 extends downward and outward along the ground level approximately three (3) feet in the direction of the encroaching low-level floodwater 50. The flap 11 further comprises multiple enhancements to secure the apparatus 10 such as weights 17, anchoring straps 16, and anchoring rods 18. The weights 17 provide a stabilizing means to the apparatus 10 using a plurality of internal high-density plates being contained within a series of integral pockets. The flap 11 further comprises an attachment means to a plurality of anchoring straps 16 using such methods as sewing, rivets, or the like. The anchoring straps 16 comprise a plurality of eyelets 19 and anchoring rods 18. The anchoring straps 16 are envisioned to be provided a series of said straps 16 along the edge of the flap 11 at a spacing of approximately every twelve (12) to sixteen (16) inches. The anchoring rods 18 are envisioned to be approximately twelve (12) to sixteen (16) inches long and are envisioned to be inserted through the eyelets 19 and driven into the ground by a maul or other similar driving tool thereby securely fastening the apparatus 10 the ground surface. The anchoring rods 18 each have a head portion large enough to cover the diameter of the each eyelet 19.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The preferred embodiment of the present invention is designed to be used by an average person with some skills and minimal training necessary.

The present invention 10 an apparatus and system to quickly and easily deploy a flood control barrier system that replaces bulky and cumbersome sandbags. The proper use of the residential flood control system 10 effectively prevents flood waters from rising up into one's property and successfully diverts the water towards another direction.

The method of installing and utilizing the apparatus 10 may be achieved by performing the following steps: determining the position and number of bladder units 12 needed based upon the surface topography and the particular property to be protected; arranging the apparatus 10 in such a pattern as to divert the low-level flood waters 50 in the desired direction; attaching a plurality of bladder units 12 by inserting the ends of said bladder units 12 completely into the connecting sleeve 14 on the adjacent unit 12; anchoring said bladder units 12 into position by driving the anchoring rods 18 through the eyelets 19, contained thereon the anchoring straps 16, into the ground using a maul or similar driving tool; filling the bladder units 12 with water to capacity being careful to exhaust all entrapped air thereby avoiding unwanted floating of the apparatus 10 during the high water condition; and, benefiting from the protection of one's properties by diverting damaging low-level flood waters 50 until such waters abate.

During flood conditions, the user obtains a single unit of the flood control system 10 from its nearby storage location and proceeds to place it in the pathway of rising flood waters and orient it in such a way as to channel the flood waters towards a safer and less destructive path. The weighted flap portion 11 is placed on the water side of the bladder 12 to provide additional support for the single unit. A fill tube 13 located on the body of the heavy-duty bladder 12 has a threaded connection to allow it to be filled with water or other liquid. The weight of the water-filled bladder 12 and flap 11 insures that the single unit can conform to local ground conditions and grades and is impervious to the flood waters.

If necessary, each unit has a sleeve 14 slightly larger in diameter than a filled bladder 12 in order to interconnect the first bladder 12 with another bladder unit 12. Additional units 12 may also be stacked on top of one another to form a complete barrier to the flood waters and also through the interconnecting sleeves 14 to provide a greater coverage area for flood water protection.

When the need for the residential flood control system 10 has passed, the individual bladder units 12 can break down by merely disconnecting each bladder 12 from one another's connecting sleeve 14 and removing the water or liquid from within the bladder 12 by means of gravity or forced drainage through a drain plug 15 located on the bladder 12 on the opposite vertical side of the fill tube 13.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An apparatus for holding back low-level flood waters pooled adjacent to a building structure foundation, said apparatus comprising:

a plurality of detachably interconnected bladder units positioned end-to-end along an edge of the flood waters, each of said bladder units including a sleeve interconnected with an adjacent one of said bladder units and thereby forming a continuous barrier to prevent undesirable encroaching of the flood waters;

a plurality of flaps pivotally attached to each of said bladder units respectively, each said bladder units being provided with a fill plug and a drain plug operably attached thereto, said flaps being attached to an upper central region of said bladder units and extending along an entire longitudinal length thereof respectively, said flaps extending downwardly and outwardly along a ground level towards the flood waters; and, means for anchoring said flaps to the ground during operating conditions such that said bladder units are prohibited from being displaced along the ground;

wherein each of said bladder units are adaptable for housing a predetermined volume of fluid therein;

wherein said sleeve has a proximal end circumferentially connected to a first end of an associated one of said bladder units, said sleeve extending distally and longitudinally away from said first end wherein a distal end of said sleeve is directly mated to an adjacent one of said bladder units for creating a continuous series of interconnected bladder units;

wherein said sleeves are permanently and integrally coupled to said bladder units respectively; and, wherein said flaps have a first end terminating at said upper central region of said bladder unit such that said flaps extend along only one side of said bladder units respectively.

2. The apparatus of claim 1, wherein said fill plug is located on an upper half surface of said bladder unit, said fill plug including a tubular orifice provided with a threaded cap attached thereto, said drain plug being located on a lower half of said bladder unit for draining the fluid out from said bladder unit.

3. The apparatus of claim 1, wherein said anchoring means comprises:

a plurality of anchoring straps and a plurality of anchoring rods, said anchoring straps being permanently coupled directly to said flap and terminating away from a lateral edge thereof, each of said anchoring straps being provided with an eyelet wherein said anchoring rods are driven through said eyelets and into the ground to thereby securely fastening said bladder unit to the ground;

wherein said anchoring rods each have a head portion large enough to cover a diameter of said eyelet.

4. The apparatus of claim 1, wherein said flap further comprises:

at least one pouch formed along a body thereof; and, at least one weight member removably positioned within said pouch for preventing said bladder unit from undesirably traveling along the ground;

wherein said weight member comprises a flat rectangular plate; and, wherein said weight member positioned therein said pouch of said flap enables a selectable means of quickly configuring said flap towards said low-level flood waters.

5. An apparatus for holding back low-level flood waters pooled adjacent to a building structure foundation, said apparatus comprising:

a plurality of detachably interconnected bladder units positioned end-to-end along an edge of the flood waters, each of said bladder units including a sleeve interconnected with an adjacent one of said bladder units and thereby forming a continuous barrier to prevent undesirable encroaching of the flood waters;

a plurality of flaps pivotally attached to each of said bladder units respectively, each said bladder units being provided with a fill plug and a drain plug operably attached thereto, said flaps being attached to an upper central region of said bladder units and extending along an entire longitudinal length thereof respectively, said flaps extending downwardly and outwardly along a ground level towards the flood waters, said flaps being connected longitudinally to an upper central region of said bladder unit and extending downwardly and outwardly to approximately double a diameter of said bladder; and, means for anchoring said flaps to the ground during operating conditions such that said bladder units are prohibited from being displaced along the ground;

wherein each of said bladder units are adaptable for housing a predetermined volume of fluid therein;

wherein said sleeve has a proximal end circumferentially connected to a first end of an associated one of said bladder units, said sleeve extending distally and longitudinally away from said first end wherein a distal end of said sleeve is directly mated to an adjacent one of said bladder units for creating a continuous series of interconnected bladder units;

wherein said sleeves are permanently and integrally coupled to said bladder units respectively; and, wherein said flaps have a first end terminating at said upper central region of said bladder unit such that said flaps extend along only one side of said bladder units respectively.

6. The apparatus of claim 5, wherein said fill plug is located on an upper half surface of said bladder unit, said fill plug including a tubular orifice provided with a threaded cap attached thereto, said drain plug being located on a lower half of said bladder unit for draining the fluid out from said bladder unit.

7. The apparatus of claim 5, wherein said anchoring means comprises:

a plurality of anchoring straps and a plurality of anchoring rods, said anchoring straps being permanently coupled directly to said flap and terminating away from a lateral edge thereof, each of said anchoring straps being provided with an eyelet wherein said anchoring rods are driven through said eyelets and into the ground to thereby securely fastening said bladder unit to the ground;

wherein said anchoring rods each have a head portion large enough to cover a diameter of said eyelet.

8. The apparatus of claim 5, wherein said flap further comprises:

at least one pouch formed along a body thereof; and, at least one weight member removably positioned within said pouch for preventing said bladder unit from undesirably traveling along the ground;

wherein said weight member comprises a flat rectangular plate; and, wherein said weight member positioned therein said pouch of said flap enables a selectable means of quickly configuring said flap towards said low-level flood waters.

* * * * *